US005410926A

United States Patent [19]

Saito

[11] Patent Number: 5,410,926

[45] Date of Patent: May 2, 1995

[54] UPPER TOOL FOR A PRESS

[75] Inventor: Hiroshi Saito, Odawara, Japan

[73] Assignee: Amada Metrecs Company, Limited, Japan

[21] Appl. No.: 98,030

[22] Filed: Jul. 28, 1993

[51] Int. Cl.[6] ..... B26D 7/06

[52] U.S. Cl. ..... 83/136; 83/140

[58] Field of Search ..... 83/139, 138, 140, 142, 83/143, 137, 136, 543; 188/268

[56] References Cited

U.S. PATENT DOCUMENTS

| | | | |
|---|---|---|---|
| 3,622,067 | 11/1971 | Bucy | 83/917 |
| 4,048,889 | 9/1977 | Finley | 83/139 X |
| 4,631,996 | 12/1986 | Magnuson | 83/129 X |
| 5,176,057 | 1/1993 | Chun et al. | 83/139 |

FOREIGN PATENT DOCUMENTS 3-4318 1/1991 Japan .

*Primary Examiner*—Kenneth E. Peterson

*Attorney, Agent, or Firm*—Wigman, Cohen, Leitner & Myers

[57] ABSTRACT

In an upper tool, a stripper plate (35) is disposed movably up and down at a lower end portion (13*a*) of a punch guide (13) for housing a punch (27) also movably up and down, via a shock damping member (33). Further, the shock damping member (33) is formed into an annular body disposed so as to enclose an annular gap (X) formed between the lower end portion (13*a*) of the punch guide (13) and the upper surface (65) of the stripper plate (35). The upper tool can reduce noise sound generated during punching processing, and further prevent chips produced during punching processing from adhering onto the workpiece and the shock damping member, thus protecting the workpiece from being scratched by the chips and further improving the life time of the shock damping member.

1 Claim, 3 Drawing Sheets

UPPER TOOL FOR A PRESS

BACKGROUND OF THE INVENTION

1. Field of the Invention

The present invention relates to an upper tool used to effect a press processing in a plate-shaped workpiece in cooperation with a lower tool.

2. Description of the Prior Art

Conventionally, in an upper tool mounted on a turret punch press for instance, a punch is housed in a cylindrical punch guide so as to be movable up and down. Further, the punch guide is formed of a metal, and a shock damping material such as urethane may be attached to the lower end surface of the punch guide. The shock damping material serves to reduce a noise generated during the punching processing.

In the conventional upper tool whose punch guide is formed of only a metal, since the punch guide is directly brought into contact with a plate-shaped workpiece, there exists a problem in that a noise is inevitably produced during punching processing, thus deteriorating, the working environment markedly.

In the case where the shock damping material such as urethane is attached to the lower end surface of the punch guide, needle-shaped chips (refuse) produced during the punching processing may adhere onto the shock damping material. Thus, there exists another problem in that the plate-material may be scratched by the needle-shaped chips adhered to the shock damping material.

SUMMARY OF THE INVENTION

It is the object of the present invention to overcome the above-mentioned problem, and to provide an upper tool which can reduce the punching noise and prevent needle-shaped chips from adhering onto the upper tool during the punching processing.

To achieve the above-mentioned object, the present invention provides an upper tool wherein a stripper plate (35) is disposed at a lower end portion of a punch guide (13) via a shock damping member (33). Further, the shock damping member (33) is an annular body disposed so as to enclose an annular gap (X) formed between the lower end portion of the punch guide (13) and an upper end portion of the stripper plate (35).

In the upper tool according to the present invention, the stripper plate is disposed at the lower end portion of the punch guide via the shock damping member, it is possible to reduce the noise generated when the stripper plate collides with the workpiece during punching processing. This is because a shock can be absorbed by the shock damping member. In addition, since the width of the gap between the stripper plate and the punch guide is small, it is possible to prevent the shock damping member from being deformed excessively during the punching processing and thereby to improve the life time of the shock damping member.

DETAILED DESCRIPTION OF THE PREFERRED EMBODIMENTS

An embodiment of the upper tool will be described hereinbelow with reference to the attached drawings.

Figure 3:
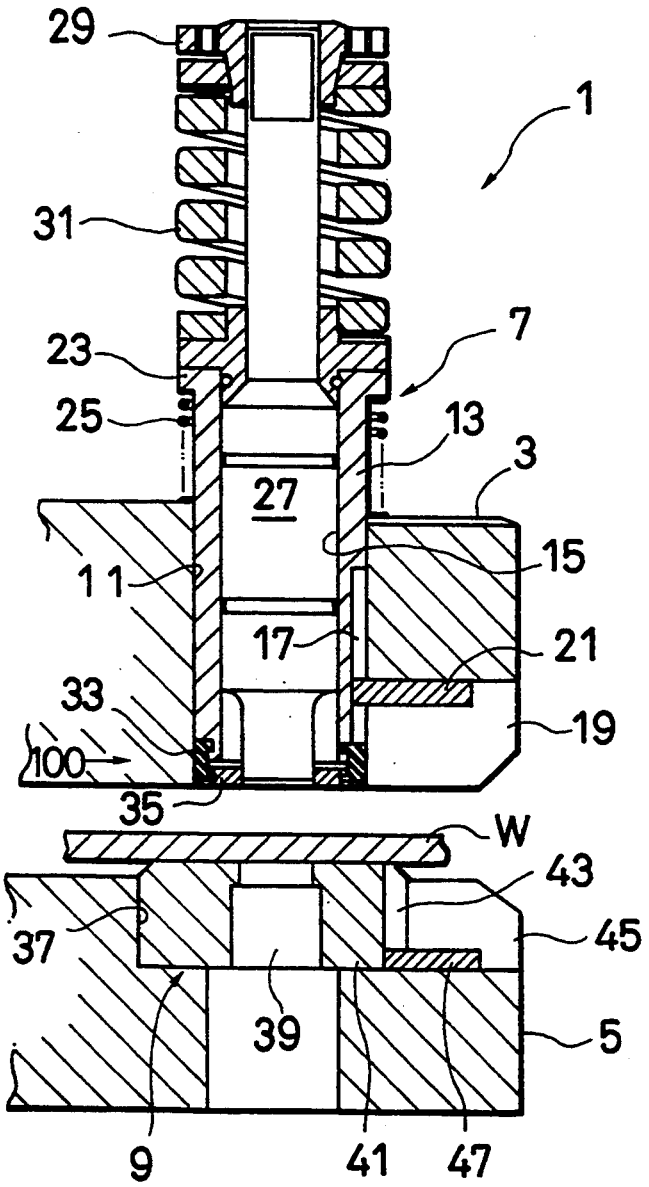
FIG. 3 is a cross-sectional view of upper and lower tools according to the present invention.

In FIG. 3, a turret punch press 1 as an example of press machines is provided with an upper turret 3 (upper tool holding member) and a lower turret 5 (lower tool holding member) both arranged in opposing positional relationship with respect to each other. An upper tool 7 is removably mounted on the upper turret 3, and a lower tool 9 is also removably mounted on the lower turret 5, respectively.

The upper turret 3 is formed with an upper tool mounting hole 11. A cylindrical punch guide 13 is fitted into the upper tool mounting hole 11 so as to be movable up and down. Further, in order to prevent the punch guide 13 from rotating relative to the upper turret 3, the punch guide 13 is formed with an appropriate number of vertically extending key grooves 17, and the upper turret 3 is formed with an appropriate number of cutout portions 19 communicating with the upper tool mounting holes 11, respectively. An appropriate number of keys 21 are provided horizontally so as to engage with the key grooves 17, respectively. Further, a lift spring 25 is interposed between an upper flange 23 of the punch guide 13 and the upper surface of the upper turret 13 to urge the punch guide 13 upward.

A punch 27 is fitted into a through hole 15 of the punch guide 13 so as to be movable up and down. The punch 27 is reduced gradually in diameter at the lower end portion of the punch 27 so as to form a processing section. The punch 27 is provided with a punch head 29 at the upper end portion thereof. A stripper spring 31 is interposed between the punch head 29 and the flange 23 of the punch guide 13 to urge the punch 27 upward. The spring constant of this stripper spring 31 is determined to be larger than that of the lift spring 25.

A stripper plate 35 is attached to the lower end surface of the punch guide 13 via a shock damping member 33 formed of an elastic material such as urethane rubber, silicone rubber, etc. The lower turret 5 is formed with a lower tool mounting hole 37 in opposing positional relationship with respect to the upper tool mounting hole 11. A lower tool 41 formed with a hole 39 is fitted into this lower tool mounting hole 37. Further, in order to prevent the lower tool 41 from rotating relative to the lower turret 5, the lower tool 41 is formed with an appropriate number of vertically extending key grooves 43, and the lower turret 5 is formed with an appropriate number of cutout portions 45 communicating with the lower tool mounting holes 37, respectively. An appropriate number of keys 47 are provided horizontally so as to engage with the key grooves 43, respectively.

In the above-mentioned construction, when the punch head 29 is struck by a striker of a punch press (not shown), the punch 27 is moved downward, and the punch guide 13 is also moved downward against the elastic force of the lift spring 25. Therefore, the punch guide 13 provided with the stripper plate 35 and the shock damping member 33 are also moved downward to press a plate-shaped workpiece W onto the lower tool 9. When the punch 27 is moved further downward, the punch 27 is moved further downward relative to the punch guide 13 against the elastic force of the stripper spring 31, that a required press processing (e.g., punching processing) to the plate-shaped workpiece W is completed in cooperation with the lower tool 9.

The upper tool 7 including the punch guide 13, the shock damping member 33, and the stripper plate 35 will be described in more detail hereinbelow with reference to FIGS. 1 and 2.

Figure 2:
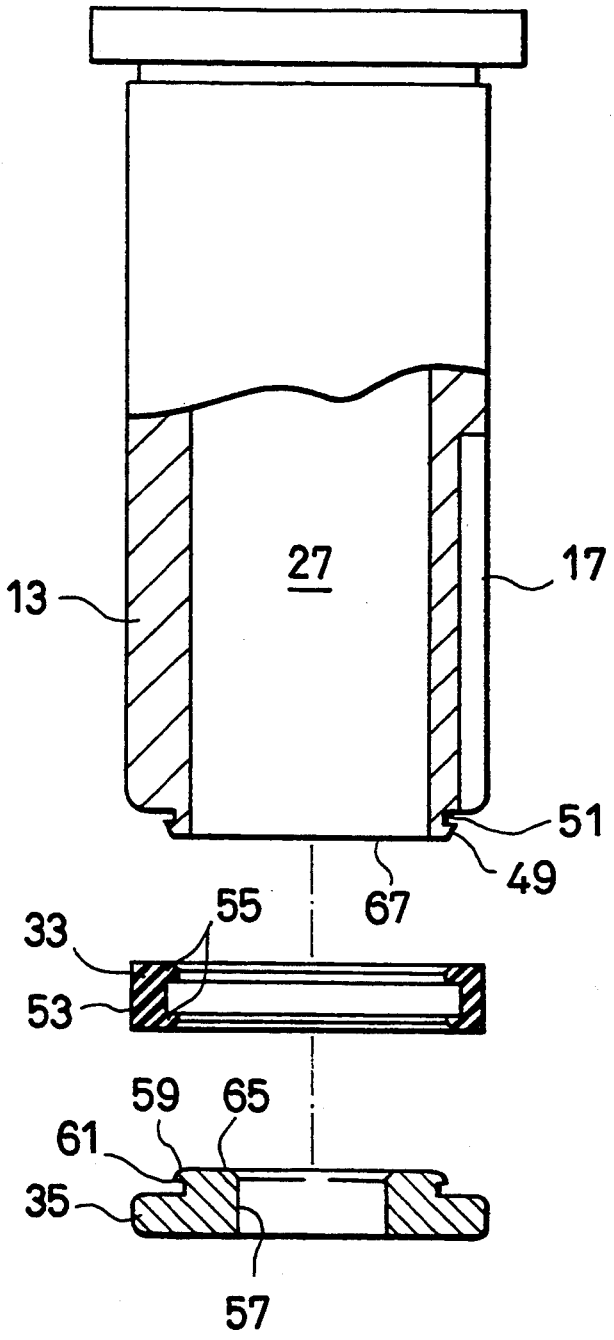
FIG. 2 is an exploded view showing the upper tool shown in FIG. 1.

As shown particularly in FIG. 2, the punch guide 13 is formed with an outer annular recessed groove portion 51 and an outer engage projection 49 for supporting the shock damping member 33 at the lower end portion 13*a* thereof. The shock damping member 33 is an annular-shaped member having an outer annular body portion 53 and two inner projection portions 55 formed in the inner circumferential surface of the outer annular body portion 53. As mentioned before, the shock damping member 33 is formed of an elastic material such as urethane rubber, silicone rubber, etc. The upper side of the two inner projection portions 55 of the shock damping member 33 is removably engaged with the outer annular recessed groove portion 51 of the punch guide 13.

Further, the stripper plate 35 made of a metal is a disk-shaped member formed with a central through hole 57 for allowing the punch 27 to pass therethrough. The stripper plate 35 is formed with an outer projection portion 59 and an outer recessed portion 61 at the upper portion thereof. Thus, the lower side of the two inner projection portions 55 of the shock damping member 33 is removably engaged with the outer recessed portion 61 of the stripper plate 35.

Figure 1:
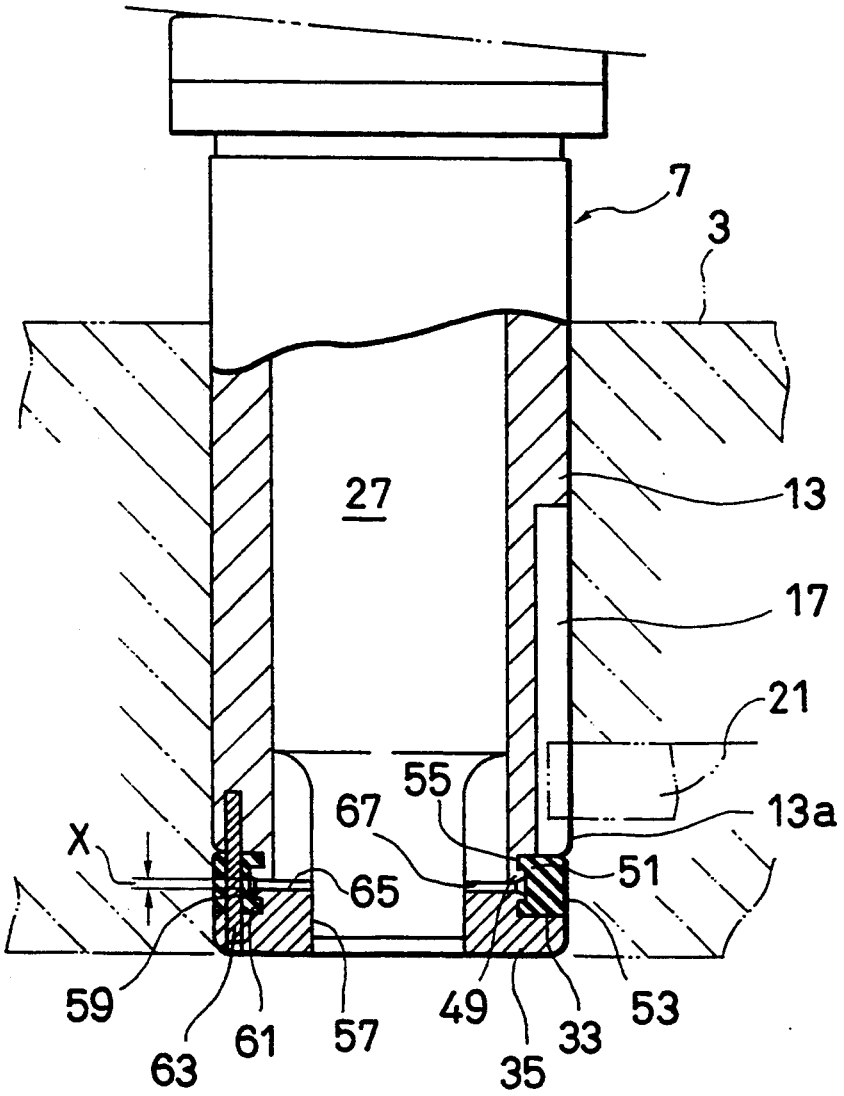
FIG. 1 is an enlarged cross-sectional view showing the essential portion of the upper tool according to the present invention, indicated by an arrow 100 in FIG. 3.

As shown in FIG. 1, a plurality of stop pins 63 are inserted vertically into the punch guide 13 through the stripper plate 35 and the shock damping member 33 in order to prevent the rotation of the stripper plate 35 and the shock damping member 33 relative to the punch guide 13. Further, in order to attach the stripper plate 35 to the punch guide 13 via the shock damping member 33, it is preferable to provide the vertical gap X between the stripper plate 85 and the shock damping member 33. To be precise, it is preferable to provide a gap X between the upper surface 65 of the stripper plate 35 and the lower surface 67 of the end portion 13*a* of the punch guide 13. The dimension of the gap X is preferably about 1 mm, for instance.

In the upper tool constructed as described above, when the metallic stripper plate 35 collides with the workpiece W during a punching processing, the shock damping member 33 attached to the lower end of the punch guide 13 serves to damp the shock and therefore absorb noise thanks to the cushion function thereof. Thus, it is possible to reduce punching noise and thereby to improve the working environment. Furthermore, the deformation of the shock damping member 33 is equal to or less than the gap X (about 1 mm) since the upper surface 65 of the stripper plate 35 collides with the lower surface 67 of the punch guide 13 if the shock damping member 33 might be deformed excessively; thus, the shock damping member 33 is prevented from being deformed excessively, thus improving the life time. Further, since the stripper plate 35 is provided with no shock damping member at the end surface thereof, needle-shaped chips (refuse) produced during the punching processing does not adhere to the stripper plate 35. Thus, the workpiece W is protected from being scratched by the chips.

Further, in the upper tool according to the present invention, the above-mentioned shock damping member can be modified in shape and material from the design standpoints, without being limited to only the above-mentioned embodiment.

As described above, in the upper tool according to the present invention, since the shock damping member is provided between the punch guide and the stripper plate, it is possible to prevent noise sound generated when the workpiece W is sandwiched between the upper tool and the lower tool during the punching processing, thus improving the working environment. Further, since the needle-shaped chips produced during the punching processing will not scratch the upper surface of the workpiece. W and the shock damping member, it is possible to protect the workpiece from being scratched and further to improve the life time of the shock damping member.

What is claimed is:

1. An upper tool for a punch press which includes an upper tool holding member, comprising:

a punch guide adapted to be mounted on the upper tool holding member so as to be movable up and down, the punch guide having a lower end portion;

a shock damping member mounted on the lower end portion of the punch guide; and a stripper plate mounted on the shock damping member, wherein the punch guide and the stripper plate are formed with outer engage projections, respectively, and the shock damping member is formed with upper and lower inner projection portions, and the outer engage projections of the punch guide and the stripper plate are adapted to engage with the upper and lower inner projections, respectively.

* * * * *